United States Patent [19]

Tanaka

[11] Patent Number: 4,687,354

[45] Date of Patent: Aug. 18, 1987

[54] DOT MATRIX PRINTER HEAD

[76] Inventor: Kazumi Tanaka, Hamadayama 4-27-25, Suginami-ku, Tokyo, Japan

[21] Appl. No.: 775,404

[22] Filed: Sep. 12, 1985

[51] Int. Cl.[4] ..... B41J 3/12

[52] U.S. Cl. ..... 400/121; 101/93.04; 101/93.48; 400/124

[58] Field of Search ..... 400/124, 157.2, 121; 101/93.04, 93.05, 93.48

[56] References Cited

U.S. PATENT DOCUMENTS

| | | | |
|---|---|---|---|
| 3,217,640 | 11/1965 | Bradshaw | 400/124 X |
| 3,900,094 | 8/1975 | Larsen | 400/124 |
| 4,046,244 | 9/1977 | Velazquez | 400/124 |
| 4,101,017 | 7/1978 | Englund | 400/124 |
| 4,156,960 | 6/1979 | Ikeda | 400/124 X |
| 4,218,149 | 8/1980 | Okada | 400/124 |
| 4,218,150 | 8/1980 | Swaim | 400/124 |
| 4,230,411 | 10/1980 | Grottrup | 400/124 X |
| 4,236,836 | 12/1980 | Hodne | 400/124 |
| 4,474,485 | 10/1984 | Sekiguchi | 400/124 X |
| 4,572,070 | 2/1986 | Moulin | 400/124 X |

*Primary Examiner*—Paul T. Sewell

*Attorney, Agent, or Firm*—Arthur T. Fattibene

[57] ABSTRACT

A reduced size and power dot matrix printing head having a chair shaped yoke with opposed off-set portions. Electromagnets are secured to the inner sides of the opposed off-set portions of the yoke permitting staggering of the electromagnets. Heavy biasing springs for securing the print pins in an inoperative position are avoided reducing the size and power of the electromagnets needed resulting in a further reduction in the overall size and power of the dot matrix printing head.

6 Claims, 5 Drawing Figures

DOT MATRIX PRINTER HEAD

SUMMARY OF THE INVENTION

This invention relates to dot matrix printing head which includes a chair shaped yoke having opposed off-set portion wherein one end of the electromagnets are firmly secured to the inner side of the opposed off-set or vertical portion of the yoke so as to enable the electromagnets to be staggered for rendering the matrix printing head to be reduced in size.

The purpose of this invention is to enable the number of printing elements to be increased, if desired and/or to make the dot matrix printing head as compact as possible.

Further, a plurality of dot printing elements, each being formed of a thin sheet, are contiguously stacked to form the dot matrix printer whereby the forward and backward movements, i.e. the operative and inoperative position of the printing elements is effected by the different electromagnets which are separately actuated. That is the forward or operative movement of the printing element is effected by electromagnets which are secured to the chair shaped yoke, and the backward movement of the printing elements is effected by the front side electromagnets.

In addition to the above, a means in the form of a comb type spring is provided for maintaining the printing element in their inoperative position.

DESCRIPTION OF THE PRIOR ART

FIG. 5 illustrates the known prior art wherein the electromagnets 2, 2 . . . are disposed around the inner surrounding position of the casing 1. In this arrangement 24 electromagnets are disposed as shown. Increasing the number of printing elements which require an increase in the number of electromagnet for the actuation thereof, thereby causes the casing 1 to be enlarged or increased because of the additional electromagnets which may be required. Thus a printing head tends to increase in size in accordance with the number of printing elements.

It is an object of this invention, to reduce the size of the printing head as illustrated in FIG. 4, while maintaining the number of electromagnets, as for example 24, as indicated in the prior art construction illustrated by FIG. 5. This arrangement contenplated by the present invention therefore enables the casing 1 to be reduced whereby the overall printing head is proportionally reduced in size.

Further, in dot matrix printers of known prior art construction, the printing element are generally actuated by electromagnets to extend them toward the printing position and that a compression spring is utilized to return the printing elements to their inoperative or non-printing position. Because of the spring bias exerted on the printing heads of the prior art construction, the electromagnets utilized in the prior art required a relatively large capacities in order to overcome the force of the springs exerted on the printing heads in order to effect the positive movement of the printing elements toward its operative printing position. A feature of this invention resides in the provision whereby the need of utilizing relatively large capacity electromagnets can be avoided since the present invention does not contemplate the use of springs for retracting the respective printing elements.

DESCRIPTION OF THE PREFERRED EMBODIMENTS

Figure 1:
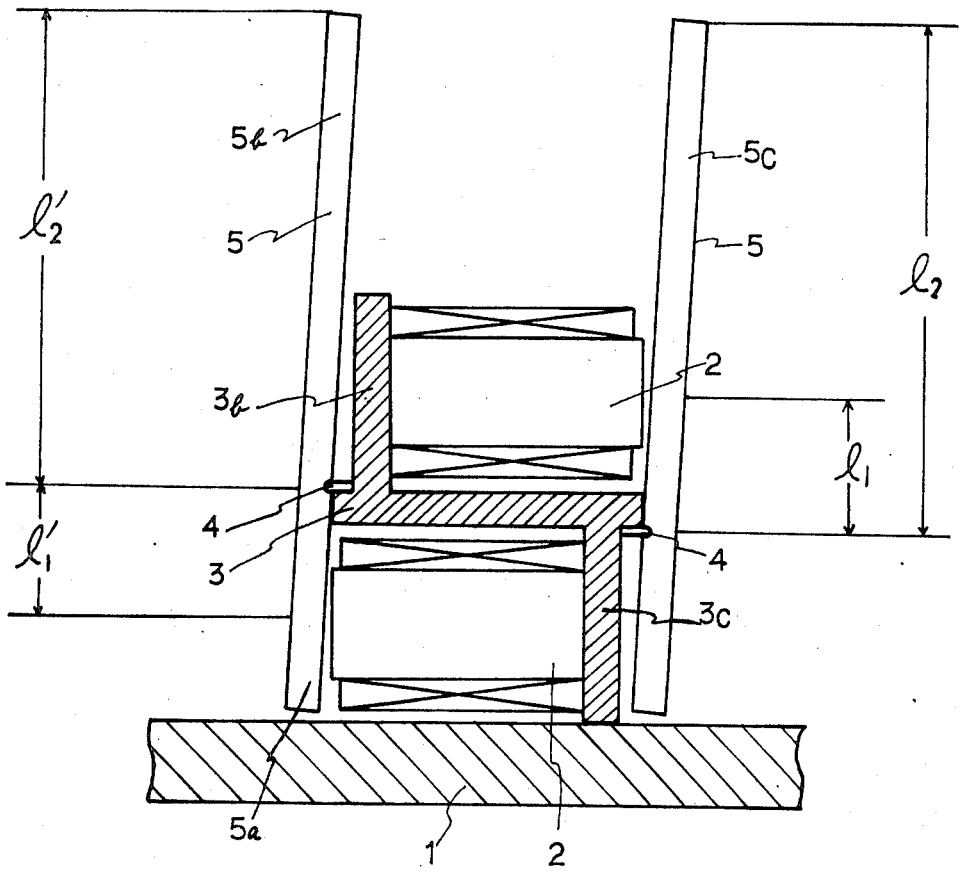
FIG. 1 shows a portion of a dot matrix printer head embodying the present invention.

FIG. 1 shows a portion of a dot matrix printer head embodying the present invention. Yoke 3 is firmly fixed on the inner side of casing 1. Yoke 3 is specially designed or shaped like a chair or step having a seat or step portion 3*a* and connected off-set or riser portions 3*b*, 3*c* oppositely opposed relative to the seat portion 3*a*. Electromagnets 2, 2 are disposed and fixed at the inner side of the vertical or riser portion 3*b*, 3*c* of yoke 3. Fulcrums 4,4 are disposed at both ends of the horizontal seat portion 3*a* of the yoke 3, and armatures 5,5 are pivotally supported at the fulcrums 4,4. The armatures 5,5 are operated and actuated by the electromagnets 2, 2. Therefore, as shown in FIG. 1, the left armature 5 supported by fulcrum 4 has the lower portion 5*a* of the armature being actuated or operated by the outer or lower side of the magnet 2. Accordingly, the inner (upper) side 5*b* of the armature 5 moves forward, that is to the left, and backward, that is to the right. Also, the right armature 5 supported on the other fulcrum 4 is disposed so that the inner (upper) 5*c* of the armature 5, which is supported by the fulcrum is operated and actuated by the inner (upper) side of the electromagnet 2. Further, as for the right side armature 5, the distance $\mathbf{1}_1$ from the right side fulcrum 4 to the center of the inner (upper) magnet 2 is the same distance as that of $\mathbf{1'}_1$, from the left side fulcrum 4 to the center of the outer (lower) magnet 2, and also the distance $\mathbf{1}_2$ from the right side fulcrum 4 to the inner (upper) end 5*c* of the right armature 5 is the same distance as that of $\mathbf{1'}_2$ from the left side fulcrum 4 to the inner (upper) and 5*b* of the left side armature 5. Therefore, $\mathbf{1}_2$ is to $\mathbf{1}_1$ as $\mathbf{1'}_2$ is to $\mathbf{1'}_1$ whereby the moving distance of the inner (upper) portion of armatures 5,5 is always the same. Also, the moving direction of these armatures is identical.

Figure 2:
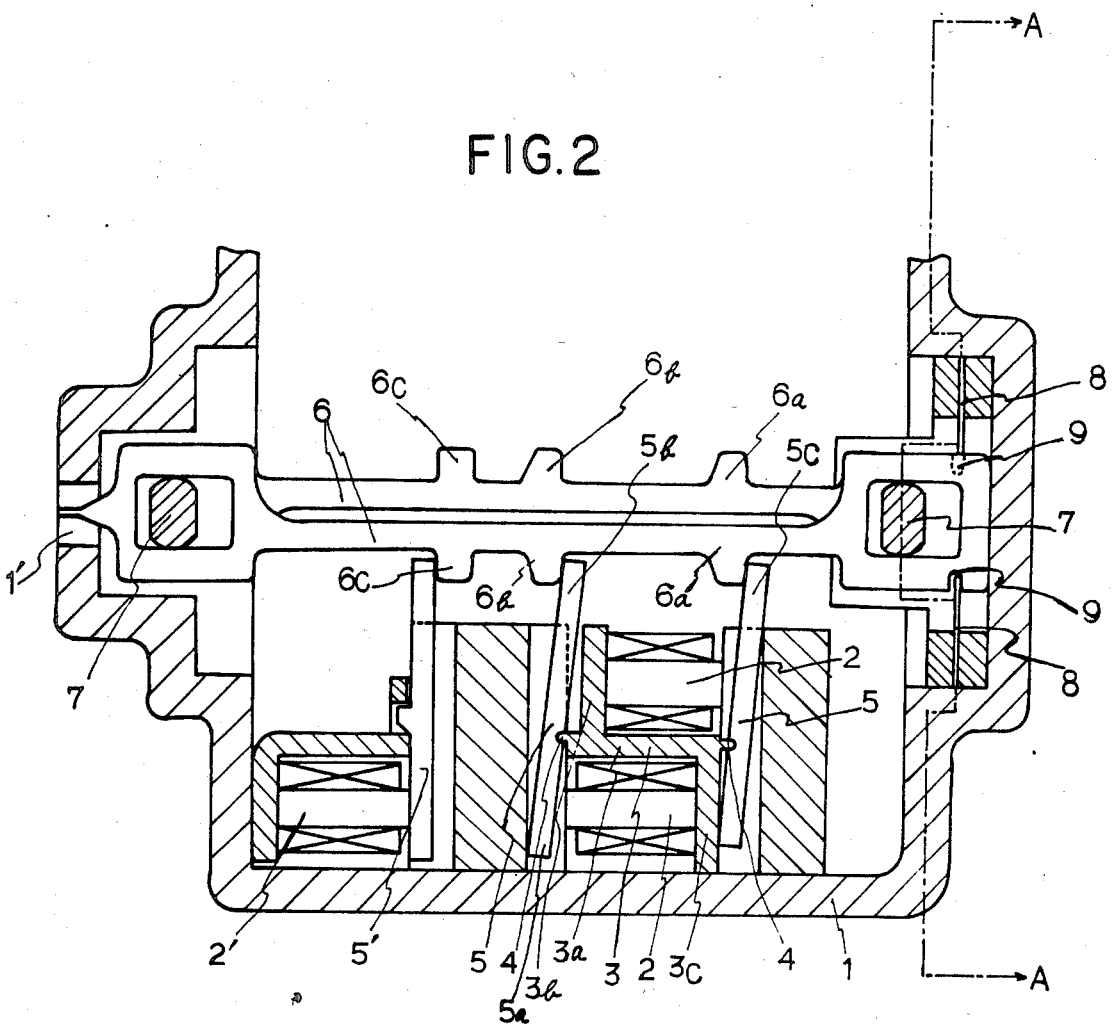
FIG. 2 shows a longitudinal section of a portion of the dot matrix printer head of the present invention.

FIG. 2 shows a longitudinal section which is a part of dot matrix printer head of this invention. On the inner side of casing 1, the yoke 3 is firmly fixed. The armatures 5,5 supported by right and left fulcrums 4,4 are disposed on the outerside of the inner (upper) and outer (lower) vertical yoke 3*b*, 3*c* and are actuated by electromagnets 2,2, fixed firmly on vertical portions of the yoke. Further, plurality of dot printing elements 6, 6 . . . which consist of thin sheets that are contiguously stacked to form the dot matrix printer at the center of casing at the intermediate portion of said printing element, there are protuberances 6*a*, 6*a* . . . which are engaged with the inner ends of the individual armatures 5,5 . . . avoiding the interferance of movement of each armatures 5, 5 . . . , each protuberances 6*a*, 6*b* . . . keep different positions which are individually connected by the end of each armatures 5, 5 . . . . These connecting points on the protuberances are always on the right hand side of said protuberances to move printing elements 6, 6 . . . toward the printing section. Further, these printing elements 6, 6 . . . , have backward or return protuberances 6c, 6c . . . which are connected with the end of the backward or return armatures 5'. Two backward magnets 2', 2' are enough to move back the said printing elements 6, 6 . . . , one of these backward armature is placed at one inner side of casing and the other at opposite side of inner casing. Printing elements 6, 6 . . . themselves have wider portion at both ends, and in this wider portion, there are holes in which guides 7,7 are adapted. Purpose of guides 7 is to direct the movement of the printing elements 6,6 toward the printing section. There is a guide hole 1' at the end of front side of casing and in this guide hole 1' printing portions of individual printing elements 6, 6 . . . freely reciprocate in accordance with the movement of armatures.

Figure 3:
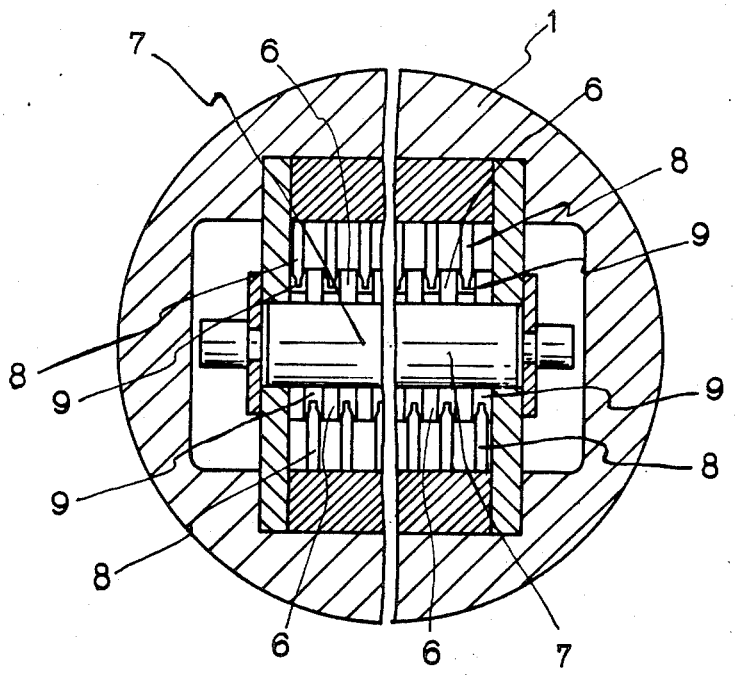
FIG. 3 is a cross-section taken along line A—A in FIG. 2.
Figure 4:
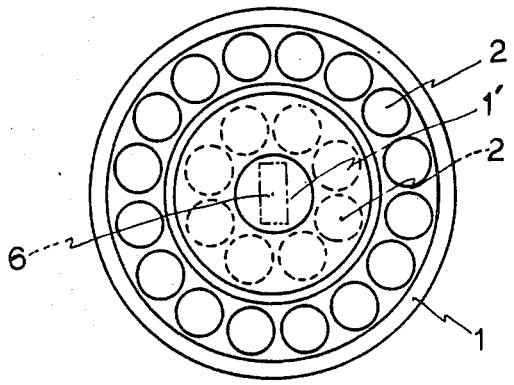
FIG. 4 illustrates the reduced size of a dot matrix printer head incorporating the present invention.
Figure 5:
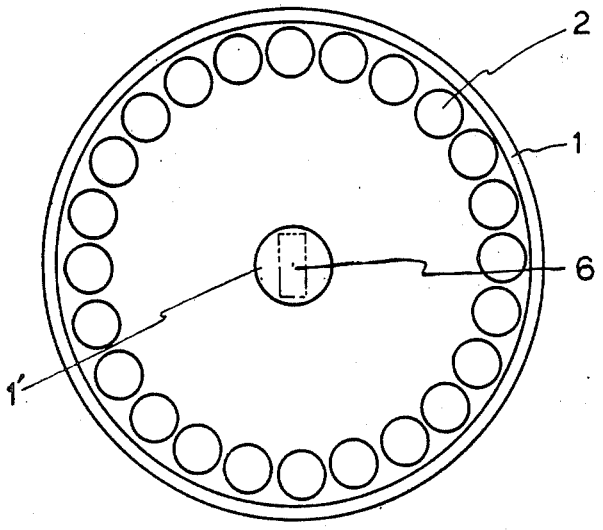
FIG. 5 illustrates the placement of electromagnets in a prior art device.

FIG. 3 shows a section of A—A in FIG. 2. As shown in FIG. 2 and FIG. 3, comb type springs 8,8 are located by both sides of printing elements 6,6 at the rear portion of casing 1 and the inner ends terminal of comb spring 8,8 are disposed toward printing elements 6,6 . . . and individual end of terminal is inserted into one of the sides of the incision or slot 9,9 . . . of the wider rear end portion of printing elements 6,6 . . . as shown in FIG. 2. As individual printing elements 6, 6 . . . are supported by said comb type springs 8, 8 . . . , when said printing elements 6 are operated and actuated by said forward and backward armature 5, these comb type springs stop the following movement of upper and lower printing elements 6, contiguous to the printing element 6 which is actuated by said armature and further when armatures 5' are operated backward by electromagnets 2', said comb type spring 8 prevents the rebound of said printing elements 6 and always keeps said printing elements 6 at home or inoperative position. Therefore, when said printing elements 6 are actuated forward by pushing on the right side of protuberance 6a by armatures 5, the inner ends of armatures 5 are always in contact therewith with no clearnace. The sides of protuberances and all the moving distance, therefore, of said printing elements are exactly the same so as to make the printed character, symbol or the like clear. Further, as the forward and backward armatures 5, 5 . . . are adjusted as said $1_2$ is to $1_1$ as $1'_2$ is to $1'_1$, the forward and backward moving distances of individual armatures are exactly the same. Also, by keeping said printing elements 6, 6 . . . always bias toward its home or inoperative position, the movement of printing elements 6, 6 . . . is very smooth and accurate in cooperation with the moving distance of said armatures 5, 5. In addition to the above, this invention enables the use of a very small capacity type of electromagnet because it is unnecessary to use strong backward or return springs common in dot matrix printer heads. For example, as shown in FIG. 4, using the same number of 24 forwarding electromagnets, their respective capacity is very small compared with that of current and prior type devices. Also, using 2 backward magnets to move printing elements to its home or inoperative position as explained before, all the electric capacity required by this described printer head is relatively very small. By this invention, as explained in details, the printer head can be made very small. Therefore, the dot matrix printer itself can be made very compact without having the dead space beside the platen which the prior known printers required. Not only the electric capacity of printer head become very small, but also that of other semiconductor elements, stepping motors, and the like become very small which tremendously reduces the overall production cost of the dot matrix printer herein described.

What is claimed is:

1. A dot matrix printing head comprising a casing, a plurality of contiguously disposed printing elements mounted in said casing for movement between an operative printing position and an inoperative non-printing position, actuating means operating on said printing elements to drive said elements toward an operative printing position, said actuating means including a chair shaped yoke mounted in said casing, said yoke each including oppositely disposed off-set portions, an electromagnet connected to said respective off-set portions whereby said electromagnets are staggered and oppositely disposed, at least one pivoting armatures fulcrumed on each opposite side of said yoke whereby said armatures complement a corresponding printing element, protruding means formed on said corresponding printing element for engaging the end of its complimentary armature whereby the actuation of said electromagnets cause said armature to pivot about its fulcrum to shift the associated printing element toward its operative position; the end of said armature acting on one side of said protruding means only.

2. A dot matrix printing head as defined in claim 1 and including second electromagnetic means for shifting said printing elements toward their inoperative position, said latter means comprising a return armature fulcrumed on a casing yoke, said printing element having a second means formed thereon for engaging the end of said return armature, and at least one electromagnet for actuating said return armature to shift all said activated printing elements to inoperative position.

3. A dot matrix printing head as defined in claim 2, and including a spring means for individually biasing each of said printing elements toward their respective inoperative position, said spring means operating on its respective printing element so as to prohibit a respective printing element from following the movement as the contiguous printing element which is actuated by its electromagnet.

4. A dot matrix printing head comprising a casing, a plurality of contiguous printing elements mounted in said casing for movement between an operative printing position and an inoperative non-printing position, actuating means operating on said printing elements to drive said elements toward an operative printing position, said actuating means including a chair shaped yoke mounted in said casing, said yoke each including oppositely disposed off-set portions, an electromagnet connected to said respective off-set portions whereby said electromagnets are staggered and oppositely disposed, armatures fulcrumed on each opposite side of said yoke whereby said armatures complement a corresponding printing element, protruding means formed on said corresponding printing element for engaging the end of its complimentary armature whereby the actuation of said electromagnets cause said armature to pivot about its fulcrum to shift the associated printing element towards its operative position; a second electromagnetic means for shifting said printing elements toward their inoperative position, said latter means comprising a return armature fulcrumed on a casing yoke, said printing element having a second means formed thereon for engaging the end of said return armature, an electromagnet for actuating said return armature to shift said printing element to inoperative position; a spring means for individually biasing each of said printing elements toward their respective inoperative position, said spring means operating on its respective printing element so as to prohibit a respective printing element from following the movement of the contiguous printing element which is actuated by its electromagnet, wherein said spring means comprises a comb spring having a series of spring terminals, and a complimentary slot formed on said printing element for receiving a terminal of said comb spring.

5. A dot matrix printing head comprising a casing, a plurality of flat printing elements disposed in close contiguous relationship within said casing at a location intermediate thereof, a chair shaped yoke having opposite off-set portions, an armature lever fulcrumed on each side of said yoke whereby each of said armature levers extend generally in the direction of said off-set portions, an electromagnet secured to the respective off-set portion of said yoke whereby said electromagnets are staggered and said electromagnets are respectively disposed so as to actuate its respective armature lever when actuated, and means formed on said printing elements for engaging the end of a corresponding armature lever whereby said printing element is shifted to operative position when its corresponding electromagnet is actuated, a comb spring, said comb spring extending transversely of said printing elements, and said comb spring being operatively connected to each of said printing elements to normally restrain its associated printing element from following the movement of a contiguous element which has been actuated.

6. Printing elements for use in a dot matrix printing head comprising a plurality of flat elements disposed in contiguous relationship, protruding means longitudinally spaced along each of said elements, said protruding means including a forwardly protruding means and a backward protruding means, projecting actuating means and retracting actuating means, each of said projecting actuating means and retracting actuating means including an armature, the armature of said projecting actuating means engaging the protruding means of the corresponding element on one side thereof, and the armature of said retracting actuating means engaging the backward protruding means of said elements on one side thereof whereby the actuation of said respective armature effects the shifting of its corresponding element between an operative and inoperative position depending upon which of said armatures is actuated.

* * * * *